US012130011B2

(12) United States Patent
Lach et al.

(10) Patent No.: US 12,130,011 B2
(45) Date of Patent: Oct. 29, 2024

(54) STEAM BOILER SYSTEM AND METHOD OF CIRCULATING WATER AND STEAM IN A STEAM BOILER SYSTEM

(71) Applicant: MAXI-THERME INC., Montréal (CA)

(72) Inventors: Patrick Lach, Chambly (CA); Anthony G. Ranallo, Libertyville, IL (US)

(73) Assignee: MAXI-THERME INC., Montreal (CA)

( * ) Notice: Subject to any disclaimer, the term of this patent is extended or adjusted under 35 U.S.C. 154(b) by 22 days.

(21) Appl. No.: 18/076,079

(22) Filed: Dec. 6, 2022

(65) Prior Publication Data

US 2023/0175685 A1 Jun. 8, 2023

Related U.S. Application Data

(60) Provisional application No. 63/286,132, filed on Dec. 6, 2021.

(51) Int. Cl.

| | |
|---|---|
| ***F22D 1/00*** | (2006.01) |
| ***F22D 1/02*** | (2006.01) |
| ***F22D 1/34*** | (2006.01) |
| ***F22D 1/36*** | (2006.01) |
| ***F22D 5/26*** | (2006.01) |

(52) U.S. Cl.

CPC ..... *F22D 1/003* (2013.01); *F22D 1/02* (2013.01); *F22D 1/34* (2013.01); *F22D 1/36* (2013.01); *F22D 5/26* (2013.01)

(58) Field of Classification Search

CPC ... F22D 1/003; F22D 1/02; F22D 1/34; F22D 1/36; F22D 5/26

USPC ..... 122/1 C

See application file for complete search history.

(56) References Cited

U.S. PATENT DOCUMENTS

| | | | | |
|---|---|---|---|---|
| 4,173,949 | A * | 11/1979 | Roethe | F22D 1/12 122/412 |
| 9,581,328 | B2 * | 2/2017 | Schroeder | F22D 1/003 |
| 2006/0076428 | A1 * | 4/2006 | Knight | F22D 1/36 237/19 |

FOREIGN PATENT DOCUMENTS

| | | | | |
|---|---|---|---|---|
| KR | 101815586 | B1 * | 1/2018 | |
| WO | WO-2012114981 | A1 * | 8/2012 | F22D 1/003 |

OTHER PUBLICATIONS

WO 2012114981 A1—Translation (Year: 2012).*
KR-101815586-B1—Translation (Year: 2018).*

* cited by examiner

*Primary Examiner* — Steven B Mcallister
*Assistant Examiner* — Benjamin W Johnson
(74) *Attorney, Agent, or Firm* — Jacob M. Ward; Ward Law Office LLC

(57) ABSTRACT

The steam boiler system comprises a steam boiler comprising a burner and a chimney for exhausting flue gases, a feedwater line for leading feedwater to said steam boiler for producing steam, a steam line leading from said steam boiler to at least one application heat exchanger for feeding steam to said application heat exchanger, said application heat exchanger for heating an application fluid, and a condensate line leading away from said application heat exchanger for recuperating condensate from said application heat exchanger. An economizer heat exchanger is provided in said chimney, wherein at least one of said condensate return line and said feedwater line circulates through said economizer heat exchanger for allowing at least one of said condensate and said feedwater to be in heat exchange relationship with the flue gases for simultaneously cooling the flue gases while heating at least one of the condensate and the feedwater.

12 Claims, 1 Drawing Sheet

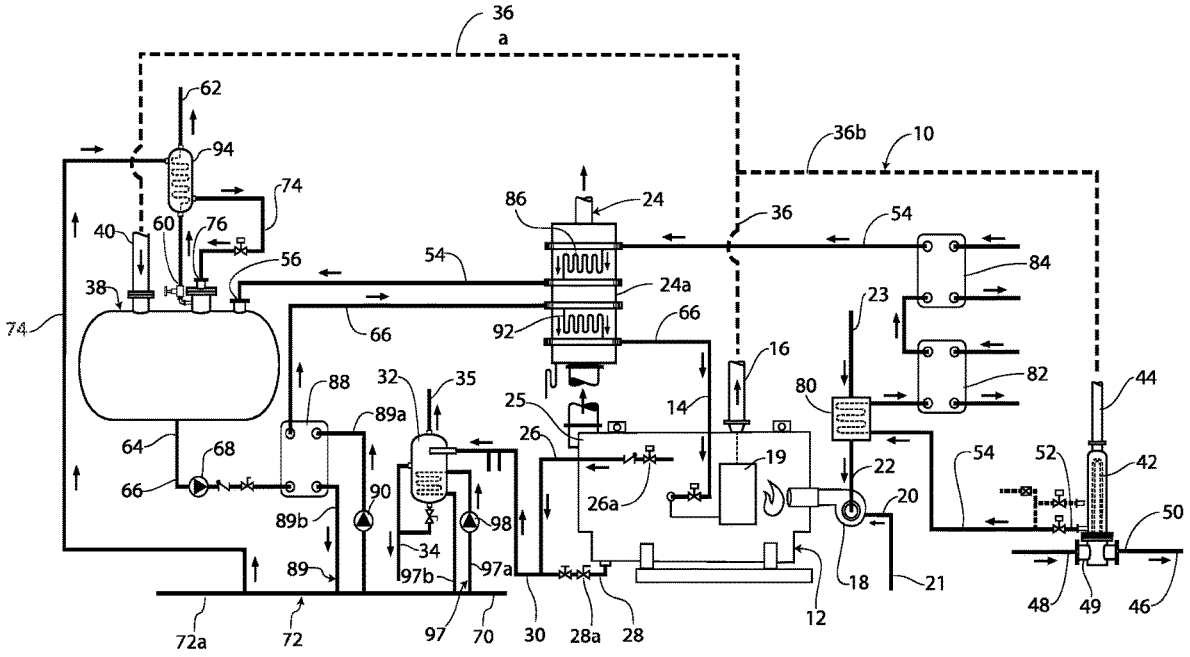
36
a
62
94
74
40
60
76
56
38
74
54
86
24
36
54
36b
10
84
24a
66
92
66
23
16
88
32
35
89a
25
14
80
82
44
64
68
26
19
22
54
52
42
66
90
26a
20
50
89b
98
34
89
97b
97a
18
21
48
49
46
72a
72
97
70
30
28a
28
12

STEAM BOILER SYSTEM AND METHOD OF CIRCULATING WATER AND STEAM IN A STEAM BOILER SYSTEM

CROSS-REFERENCE TO RELATED APPLICATIONS

This application claims the benefit of U.S. Provisional Application No. 63/286,132, filed on Dec. 6, 2021. The entire disclosure of the above application is incorporated herein by reference.

FIELD OF THE INVENTION

The invention relates to steam boiler systems that use a steam boiler to generate steam in industrial and commercial buildings for applications that require such steam—in particular, to feed the steam side of application heat exchanger; and to a method of circulating water and steam in such a steam boiler system.

BACKGROUND OF THE INVENTION

Steam boiler systems are used to generate steam in commercial or industrial buildings, for use in feeding the steam side of one or more heat exchangers that heat a fluid. The heated fluid—which can be potable or non-potable water—is used in different applications such as building heating, process water heating, domestic water heating, and the like.

More particularly, steam boiler systems have two distinct fluid circuits: a heating fluid circuit and a heated fluid circuit.

Water/steam flows continuously in a closed loop in the heating fluid circuit: liquid state water flows into a steam boiler where it is evaporated into steam. The steam is then fed into the application heat exchangers where it condenses back into water, to then flow back into the steam boiler. (Other components of the steam boiler system will be detailed below.)

The steam in the application heat exchangers will heat a fluid that circulates in the distinct heated fluid circuit, and it is that heated fluid which is used within the applications themselves. For instance, one application might be building heating wherein water is heated in the application heat exchanger, to then be circulated in the radiators in the rooms of the building that will be heated through heat transfer from the hot fluid. The heated water, once it has been used e.g., as a heating source in radiators, may circulate back to the heat exchangers to be heated once again. In other applications, the heated fluid might not form a closed loop: for instance, the heated fluid might be hot water to be dispensed in sinks and showers.

Although the water/steam runs in a closed loop in the heating fluid circuit of the steam boiler system, make-up water is still added to the water line to compensate losses within that closed loop—e.g., some filtering devices and some venting devices are used to respectively filter the water from macroparticles and remove non-condensable gases from the liquid water line. In at least those instances, water losses occur in the system and the make-up water compensates those.

To transform the water into steam, the steam boiler uses a gas fire burner that uses air and fuel to generate a flame that will evaporate the water received at the steam boiler. The combustion of gas and air at the gas fire burner generates flue gases that are exhausted through a chimney.

The combustion efficiency in a steam boiler system will obviously influence its operation costs. The combustion efficiency is generally a ratio of the actual fuel heating value per pound of fuel being burned vs. the theoretical or maximum fuel heating value per pound of fuel. It is known to calculate the combustion efficiency using the Siegert formula, to determine flue losses (qA) from which efficiency may be derived. The Siegert formula is:

$$qA = (Ts - Ta) \times \left( \frac{A2}{(21 - O_2)} + B \right)$$

from which the efficiency may be derived as follows:

$$\text{Efficiency} = 100 - qA$$

where:

qA=flue loss.

Ts=flue temperature. This is measured at the steam boiler chimney.

Ta=supply air temperature. This is measured in the gas fire burner air inlet.

O2=measured volumetric oxygen concentration expressed as a percentage.

A2, B=fuel dependent constants

A typical steam boiler may have an efficiency of about 80-83%. This means that there is a loss of heat of about 17-20% in the system.

SUMMARY OF THE INVENTION

Increasing the efficiency of the steam boiler system is a main objective of the present invention.

The prevent more specifically relates to a steam boiler system comprising: a steam boiler comprising a burner and a chimney for exhausting flue gases; a feedwater line for leading a feedwater to said steam boiler for producing a steam with said burner; a steam line leading from said steam boiler to at least one application heat exchanger for feeding the steam to said at least one application heat exchanger, said at least one application heat exchanger for heating an application fluid; a condensate return line leading away from said at least one application heat exchanger for recuperating condensate from said at least one application heat exchanger; and an economizer heat exchanger in said chimney, wherein at least one of said condensate return line and said feedwater line circulates through said economizer heat exchanger for allowing at least one of said condensate and said feedwater to be in heat exchange relationship with a flue gas for simultaneously cooling the flue gas while heating at least one of the condensate and the feedwater.

In one embodiment, both said condensate return line and said feedwater line circulate through respective portions of said economizer heat exchanger for allowing both said condensate and said feedwater to be in heat exchange relationship with the flue gas for simultaneously cooling the flue gas while heating both the condensate and the feedwater.

In one embodiment, said condensate return line further circulates through at least one condensate heat exchanger upstream of said economizer heat exchanger, for cooling the condensate before it comes in heat exchange relationship with the flue gas.

In one embodiment, said at least one condensate heat exchanger comprises a combustion air heat exchanger that is located upstream of said burner for simultaneously preheating an air fed into said burner and cooling the condensate.

In one embodiment, said at least one condensate heat exchanger comprises at least one heat recovery heat exchanger for simultaneously cooling the condensate and for heating a heat recovery fluid used in a heat recovery application.

In one embodiment, said feedwater line further circulates through at least one feedwater heat exchanger upstream of said economizer heat exchanger, for cooling the feedwater before it comes in heat exchange relationship with the flue gas.

In one embodiment, said condensate return line ends in a deaerator downstream of said economizer heat exchanger, and said feedwater line originates at said a deaerator upstream of said economizer heat exchanger, said deaerator for removing gases from the feedwater.

In one embodiment, steam is further circulated from said steam boiler to said deaerator for preheating said feedwater.

In one embodiment, the steam boiler system further comprises a make-up water line connected to said deaerator for feeding a make-up water into said deaerator to compensate for fluid losses within said steam boiler system, wherein said at least one feedwater heat exchanger comprises a make-up water heat exchanger located on said feedwater line downstream of said deaerator and upstream of said economizer heat exchanger, and on said make-up water line upstream of said deaerator, for simultaneously preheating the make-up water before it is fed into said deaerator and cooling said feedwater before it comes in heat exchange relationship with the flue gas.

In one embodiment, said steam boiler comprises a blowdown line that leads to a drain to evacuate a blowdown liquid, said at least one feedwater heat exchanger comprising a heat recovery heat exchanger located on said blowdown line downstream of said steam boiler and upstream of said drain, and located on said make-up water line upstream of said deaerator, for preheating the make-up water before it is fed into said deaerator in heat exchange with the blowdown liquid.

The invention also relates to a method of circulating water and steam in a steam boiler system of the type comprising: a steam boiler comprising a burner and a chimney; a feedwater line; a steam line leading from said steam boiler to at least one application heat exchanger; a condensate return line leading out of from said at least one application heat exchanger; and an economizer heat exchanger in said chimney. The method comprising: feeding a feedwater to said steam boiler through said feedwater line; using said burner to generate a steam from said feedwater; feeding said steam from said at least one application heat exchanger through said steam line; retrieving a condensate from said at least one application heat exchanger in said condensate return line; exhausting a flue gas generated by said burner through said economizer heat exchanger in said chimney; and circulating at least one of said condensate return line and said feedwater line through said economizer heat exchanger wherein at least one of said condensate and said feedwater is in a heat exchange relationship with the flue gas for simultaneously cooling the flue gas while heating at least one of the condensate and the feedwater.

In one embodiment, both said condensate return line and said feedwater line circulate through respective portions of said economizer heat exchanger, said method comprising circulating both said condensate return line and said feedwater line through said economizer heat exchanger wherein both said condensate and said feedwater are in the heat exchange relationship with the flue gas for simultaneously cooling the flue gas while heating both the condensate and the feedwater.

In one embodiment, said condensate return line further circulates through at least one condensate heat exchanger upstream of said economizer heat exchanger, the method comprising cooling the condensate before it comes in the heat exchange relationship with the flue gas within the at least one condensate heat exchanger.

In one embodiment, said at least one condensate heat exchanger comprises a combustion air heat exchanger that is located upstream of said burner, the method comprising simultaneously preheating an air fed into said burner and cooling the condensate within the combustion air heat exchanger.

In one embodiment, said at least one condensate heat exchanger comprises at least one heat recovery heat exchanger, the method comprising simultaneously cooling the condensate and heating a heat recovery fluid used in a heat recovery application, within the at least one heat recovery heat exchanger.

In one embodiment, said feedwater line further circulates through at least one feedwater heat exchanger upstream of said economizer heat exchanger, the method comprising cooling the feedwater before it comes in the heat exchange relationship with the flue gas, within the at least one feedwater heat exchanger.

In one embodiment, said condensate return line ends in a deaerator downstream of said economizer heat exchanger, and said feedwater line originates at said deaerator upstream of said economizer heat exchanger, the method comprising removing gases from the feedwater in the deaerator and circulating said condensate back at least in part to said steam boiler through said deaerator then through said feedwater line as feedwater.

In one embodiment, the method further comprises circulating steam to said deaerator from said steam boiler for preheating said feedwater.

In one embodiment, said steam boiler system further comprises a make-up water line connected to said deaerator, the method comprising feeding a make-up water into said deaerator to compensate for fluid losses within said steam boiler system; and wherein said at least one feedwater heat exchanger comprises a make-up water heat exchanger located on said feedwater line downstream of said deaerator and upstream of said economizer heat exchanger, and on said make-up water line upstream of said deaerator, the method comprising simultaneously preheating the make-up water before it is fed into said deaerator and cooling said feedwater before it comes in the heat exchange relationship with the flue gas within said make-up water heat exchanger.

In one embodiment, said steam boiler comprises a blowdown line that leads to a drain to evacuate blowdown liquid, said at least one feedwater heat exchanger comprising a heat recovery heat exchanger located on said blowdown line downstream of said steam boiler and upstream of said drain, and located on said make-up water line upstream of said deaerator, the method comprising preheating the make-up water before it is fed into said deaerator in heat exchange with the blowdown liquid within said heat recovery heat exchanger.

BRIEF DESCRIPTION OF THE DRAWINGS

In the annexed drawings, FIG. 1 is a diagram of a steam boiler system according to the present invention.

DETAILED DESCRIPTION OF THE EMBODIMENTS

FIG. 1 schematically shows a steam boiler system 10 according to the present invention, that comprises a steam boiler 12 that operates within a closed loop to heat and evaporate liquid state water into steam, that condensates back into liquid state water to be conveyed back into steam boiler 12, as described hereinafter. In FIG. 1, water lines are shown in full lines, and steam lines are shown in dotted lines.

Steam boiler 12 comprises a water inlet 14 where the liquid state water is inputted into steam boiler 12, and a steam outlet 16 where steam is outputted. A burner 18 heats the water in steam boiler 12 at a heat exchange interface 19 to evaporate the water. Burner 18 has a fuel inlet 20 to receive a suitable combustible fuel from a fuel line 21 and an air inlet 22 to receive air from an air line 23, both of which are used for the combustion. The fuel that is usually employed in known steam boiler systems is gas, although other single or combination of fuel may also be used, as will be obvious to a person skilled in the art.

Combustion flue gases are exhausted from steam boiler 12 into a flue chimney 24 through a flue chimney inlet 25. Flue chimney 24 evacuates the flue gases in a manner that is well known, including e.g., by exhausting the flue gases into the atmosphere at a flue chimney outlet (not shown).

A surface blowdown outlet 26 equipped with a surface blowdown valve 26*a* and a bottom blowdown outlet 28 equipped with a bottom blowdown valve 28*a* are provided in steam boiler 12, for intermittently recuperating the surface and bottom liquid where macroparticles accumulate in steam boiler 12. Surface and bottom blowdown outlets 26, 28 merge into a main blowdown line 30 that runs through a blowdown vessel with double wall heat recovery heat exchanger 32 (the purpose of which will be described hereinafter) and then into a drain line 34 that leads to a drain (not shown) where the blowdown liquid carrying the macro-particulate debris is evacuated. A vent line 35 is provided at blowdown vessel 32 to allow flash steam to be evacuated through a vent (not shown).

Steam from steam outlet 16 of steam boiler 12 is conveyed through a steam line 36 that splits into two segments 36*a*, 36*b*. Steam line first segment 36*a* carries steam to a deaerator 38 that receives the steam through a steam inlet 40. (Additional details will be provided about deaerator 38 below.)

Steam line second segment 36*b* conveys steam to an application heat exchanger 42 through a steam inlet 44. Application heat exchanger 42 is used to heat a fluid incoming from a cold fluid line 48 through a cold fluid inlet 49 into heat exchanger 42, and outputted through a hot fluid outlet 50 to a hot fluid outlet line 46. Hot fluid outlet line 46 leads the hot fluid, such as hot water, to different applications where hot fluid is required. Application heat exchanger 42 also has a condensate outlet 52 that allows the steam that has condensed into liquid state in application heat exchanger 42—a.k.a. "the condensate"—to be conveyed away from application heat exchanger 42 in a condensate line 54. Application heat exchanger 42 should be a flooded heat exchanger or any other suitable type of heat exchanger that a person skilled in the art would see fit to use for a particular application, such as, but not limited to, building heating, process heating or domestic water heating.

Condensate line 54 connects to deaerator 38 at a condensate inlet 56. (Other components of system 10 installed along condensate line 54 between application heat exchanger 42 and deaerator 38 are detailed below.) Within deaerator 38, non-condensable gases will be removed from the liquid state water. Also, the water is heated—but remains in liquid state—by means of the steam inputted at deaerator steam inlet 40. Also, unavoidably, some steam will be evacuated from the water together with the non-condensable gases, resulting in some water loss. These non-condensable gases and steam will be exhausted out through a non-condensable gas outlet 60 into a non-condensable gas vent line 62 towards a non-condensable gas vent (not shown) to be evacuated in a suitable manner, e.g., to the atmosphere.

The heated water exits deaerator 38 at heated water outlet 64 and is conveyed through a feedwater line 66 to steam boiler water inlet 14. (Other components of system 10 installed along feedwater line 66 between deaerator 38 and steam boiler 12 are detailed below.) A pump 68 increases the pressure in water line 66 from the low pressure upstream of pump 68 to the high pressure downstream of pump 68, for instance, from 5 to 125 P.S.I. Other suitable operating pressures can obviously be used, as will be obvious to a person skilled in the art.

A domestic water inlet 70 allows domestic water to be fed to system 10 from, e.g., the municipal domestic water grid. Water from domestic water inlet 70 is conveyed through a domestic water line 72 to a building water heater (not shown) through a water heater segment 72*a*. Upstream of water heater segment 72*a*, domestic water line 72 splits into a deaerator make-up water segment 74 that conveys water to a make-up water inlet 76 of deaerator 38 to inject make-up water to compensate for the water losses in the closed loop of steam boiler system 10. (Other components of system 10 installed along make-up water segment 74 between domestic water line 72 and deaerator 38 are detailed below.)

The description above fits or represents many general steam boiler systems. According to the present invention however, steam boiler system 10 comprises a number of heat recovery devoices, coils, or heat exchangers, that increase the efficiency of steam boiler system 10, as described hereinafter.

1. Decreasing the Flue Gas Temperature and Increasing the Supply Air Temperature with the Condensate Energy Steam boiler system 10 comprises a liquid-to-air combustion air heat exchanger in the form of a combustion air heating coil 80 that is installed on condensate line 54 downstream of application heat exchanger 42 to recuperate part of the thermal energy of the condensate to preheat the supply air that is inputted through air line 23 into the gas burner 18. Increasing the air temperature is desirable, since it directly impacts the efficiency of steam boiler 12. Indeed, as can be seen from the Siegert formula, a higher supply air temperature increases the efficiency of steam boiler 12. As detailed hereinafter, and importantly, combustion air heat exchanger 80 further has the advantage of simultaneously decreasing the temperature of the condensate in condensate line 54.

Condensate line 54 then circulates the condensate through one or more water-to-water recovery heat exchangers, e.g., two recovery heat exchangers 82, 84 as shown in FIG. 1. Recovery heat exchangers 82, 84 can be used for any purpose within the building, for instance, to heat portions of the building such as the building entrance, to pre-heat the make-up or domestic water line, or the like. Again, although recuperating heat through recovery heat exchangers 82, 84 is advantageous, one purpose of recovery heat exchangers 82,84 is to further decrease the temperature of the condensate flowing in condensate line 54, as detailed hereinafter.

Condensate line 54 then circulates the condensate through a condensing economizer gas-to-water heat exchanger in the form of an economizer coil 86 that runs through a heat exchange section 24*a* of flue chimney 24. Here, heat exchange occurs between the condensate and the flue gases that are exhausted through flue chimney 24. More particularly, thermal energy is transferred from the hot flue gases to the condensate, to preheat the condensate before it is returned to deaerator 38 and to cool the flue gases before they are exhausted through chimney 24. By having previously lowered the condensate temperature at heat exchangers 80, 82, 84, the heat exchange between the condensate and the flue gases will be improved at economizer coil 86, i.e., the transfer of energy being improved means that the cooling of the flue gases and the heating of the condensate are both improved. Per the Siegert formula, the lower the flue gas temperature, the more efficient steam boiler system 10 is. In parallel, the warmer the condensate is, the less energy is required at deaerator 38 to heat it to generate feedwater for the steam boiler 12.

2. Decreasing the Flue Gas Temperature and Increasing the Domestic Water Temperature with the Feedwater Energy Downstream of deaerator 38, the feedwater that is conveyed to steam boiler 12 from deaerator 38 through feedwater line 66 is first passed through a domestic feedwater water heat exchanger 88 that allows water-to-water heat exchange between the feedwater and the domestic water. Domestic water is conveyed to and from heater exchanger 88 by means of inlet and outlet segments 89*a*, 89*b* a first domestic water auxiliary line 89 that is connected to domestic water line 72 upstream of the connection to make-up water line 74. A first auxiliary pump 90 allows suitable pressure to be had in the domestic water side of heat exchanger 88. Heat exchanger 88 allows to preheat the domestic water being conveyed through domestic water line 72, but also allows to decrease the feedwater temperature in feedwater line 66.

Feedwater line 66 then passes through a feedwater gas-to-water economizer heat exchanger in the form of an economizer coil 92 that is installed within the heat exchange section 24*a* of chimney 24, downstream of domestic water heat exchanger 88. There, thermal energy is transferred from the flue gases to the feedwater, to preheat the feedwater before it is fed to steam boiler 12 and to cool the flue gases before they are exhausted through chimney 24. By having previously lowered the feedwater temperature at heat exchanger 88, the heat exchange between the feedwater and the flue gases will be improved at economizer coil 92, i.e., the transfer of energy being improved means that the cooling of the flue gases and the heating of the feedwater are both improved. Per the Siegert formula, the lower the flue gas temperature, the more efficient steam boiler system 10 is. In parallel, the warmer the feedwater is, the less energy is required at steam boiler 12 to transform the feedwater into steam.

3. Increasing the Domestic/Make-Up Water Temperature

The domestic water in domestic water line 72 is preheated through domestic water heat exchanger 88 as detailed above.

Furthermore, steam boiler system 10 comprises a gas-to-water heat exchanger 94 in the form of a heat exchange coil that allows heat exchange between the make-up water flowing through make-up water line segment 74 and the non-condensable gases that are being exhausted through vent line 62. This heat exchange further preheats the make-up water, using energy from the non-condensable gases that will he discharged to atmosphere and otherwise lost.

Immediately downstream of domestic water inlet 70, the domestic water that is conveyed through domestic water line 72 is first passed through blowdown heat exchanger 32 that allows water-to-water heat exchange between the domestic water and drained liquid from steam boiler 12. Inlet and outlet segments 97*a*, 97*b* of a second domestic water auxiliary line 97 conveys domestic water to and from domestic water line 72 into blowdown heat exchanger 32. A second auxiliary pump 98 allows suitable pressure to be had in the domestic water side of blowdown heat exchanger 32. Blowdown heat exchanger 32 allows to preheat the domestic water being conveyed through domestic water line 72, using energy from the drain water that will be discharged through drain line 34 and otherwise lost.

The preheating of the domestic/make-up water as detailed above allows less energy to be required at deaerator 38 to preheat the feedwater to be conveyed towards steam boiler 12; and also, less energy to be required at the building water heater that 72*a* leads to, to heat the water for warm water domestic use.

4. Increased Steam Boiler Efficiency

The net result of the improvements mentioned above, has been tested and has yielded a significant improvement in boiler efficiency in steam boiler system 10: in a steam boiler system where the efficiency was calculated at 83,90% without activating the various heat recovery and preheating heat exchangers, the boiler efficiency was raised to 98,33% as calculated with the Siegert formula with measurements of the preheated air temperature and of the cooled flue gas temperature after it passes through the economizer heat exchangers.

Main components of the steam boiler system 10 have been detailed hereinabove, but as will be obvious to a person skilled in the art, many other components can or should be installed for operation of system 10, including all types of security or maintenance valves, temperature sensors, controls, and the like.

Also, although a single of each device has been shown and described, system 10 could include multiple such devices, such as for example, multiple steam boilers, which could have respective chimneys or share a single flue chimney, which could have their respective gas burners and respective air coil heat exchanger for the gas burners; the system could have multiple heat recovery heat exchangers, multiple application heat exchangers, and so on.

In one embodiment, different types of fuel may be used as mentioned above, and the condensate section 86 of the economizer heat exchanger is only used when one type of fuel is being used, e.g., when gas is being used, but not while another different type of fuels is being used, e.g., not while oil is being used. Generally, either one or both sections 86, 92 may be selected to be used in steam boiler system 10.

What is claimed is:

1. A steam boiler system comprising:

a steam boiler comprising a burner and a chimney for exhausting flue gases;

a feedwater line for leading a feedwater to said steam boiler for producing a steam with said burner;

a steam line leading from said steam boiler to at least one application heat exchanger for feeding the steam to said at least one application heat exchanger, said at least one application heat exchanger for heating an application fluid;

a condensate return line leading away from said at least one application heat exchanger for recuperating a condensate from said at least one application heat exchanger;

an economizer heat exchanger in said chimney, wherein at least one of said condensate return line and said feedwater line circulates through said economizer heat exchanger for allowing at least one of said condensate and said feedwater to be in heat exchange relationship with a flue gas for simultaneously cooling the flue gas while heating at least one of the condensate and the feedwater, wherein said feedwater line further circulates through at least one feedwater heat exchanger upstream of said economizer heat exchanger, for cooling the feedwater before it comes in heat exchange relationship with the flue gas, wherein said condensate return line ends in a deaerator downstream of said economizer heat exchanger, and said feedwater line originates at said deaerator upstream of said economizer heat exchanger, said deaerator for removing gases from the feedwater, wherein steam is further circulated from said steam boiler to said deaerator for preheating said feedwater; and a make-up water line connected to said deaerator for feeding a make-up water into said deaerator to compensate for fluid losses within said steam boiler system, wherein said at least one feedwater heat exchanger comprises a make-up water heat exchanger located on said feedwater line downstream of said deaerator and upstream of said economizer heat exchanger, and on said make-up water line upstream of said deaerator, for simultaneously preheating the make-up water before it is fed into said deaerator and cooling said feedwater before it comes in heat exchange relationship with the flue gas.

2. A steam boiler system as defined in claim 1, wherein both said condensate return line and said feedwater line circulate through respective portions of said economizer heat exchanger for allowing both said condensate and said feedwater to be in heat exchange relationship with the flue gas for simultaneously cooling the flue gas while heating both the condensate and the feedwater.

3. A steam boiler system as defined in claim 1, wherein said condensate return line further circulates through at least one condensate heat exchanger upstream of said economizer heat exchanger, for cooling the condensate before it comes in heat exchange relationship with the flue gas.

4. A steam boiler system as defined in claim 3, wherein said at least one condensate heat exchanger comprises a combustion air heat exchanger that is located upstream of said burner for simultaneously preheating an air fed into said burner and cooling the condensate.

5. A steam boiler system as defined in claim 3, wherein said at least one condensate heat exchanger comprises at least one heat recovery heat exchanger for simultaneously cooling the condensate and for heating a heat recovery fluid used in a heat recovery application.

6. A steam boiler system as defined in claim 1, wherein said steam boiler comprises a blowdown line that leads to a drain to evacuate a blowdown liquid, said at least one feedwater heat exchanger comprising a heat recovery heat exchanger located on said blowdown line downstream of said steam boiler and upstream of said drain, and located on said make-up water line upstream of said deaerator, for preheating the make-up water before it is fed into said deaerator to exchange heat with the blowdown liquid.

7. A method of circulating water and steam in a steam boiler system of the type comprising:

a steam boiler comprising a burner and a chimney;

a feedwater line;

a steam line leading from said steam boiler to at least one application heat exchanger;

a condensate return line leading out of from said at least one application heat exchanger; and an economizer heat exchanger in said chimney;

said method comprising:

feeding a feedwater to said steam boiler through said feedwater line;

using said burner to generate a steam from said feedwater;

feeding said steam from said steam boiler to said at least one application heat exchanger through said steam line;

retrieving a condensate from said at least one application heat exchanger in said condensate return line;

exhausting a flue gas generated by said burner through said economizer heat exchanger in said chimney; and circulating at least one of said condensate return line and said feedwater line through said economizer heat exchanger wherein at least one of said condensate and said feedwater is in a heat exchange relationship with the flue gas for simultaneously cooling the flue gas while heating at least one of the condensate and the feedwater, wherein said feedwater line further circulates through at least one feedwater heat exchanger upstream of said economizer heat exchanger, the method comprising cooling the feedwater before it comes in the heat exchange relationship with the flue gas, within the at least one feedwater heat exchanger, wherein said condensate return line ends in a deaerator downstream of said economizer heat exchanger, and said feedwater line originates at said deaerator upstream of said economizer heat exchanger, the method comprising removing gases from the feedwater in the deaerator and circulating said condensate back at least in part to said steam boiler through said deaerator then through said feedwater line as feedwater; and circulating steam to said deaerator from said steam boiler for preheating said feedwater, wherein said steam boiler system further comprises a make-up water line connected to said deaerator, the method comprising feeding a make-up water into said deaerator to compensate for fluid losses within said steam boiler system, wherein said at least one feedwater heat exchanger comprises a make-up water heat exchanger located on said feedwater line downstream of said deaerator and upstream of said economizer heat exchanger, and on said make-up water line upstream of said deaerator, the method comprising simultaneously preheating the make-up water before it is fed into said deaerator and cooling said feedwater before it comes in the heat exchange relationship with the flue gas within said make-up water heat exchanger.

8. A method as defined in claim 7, wherein both said condensate return line and said feedwater line circulate through respective portions of said economizer heat exchanger, said method comprising circulating both said condensate return line and said feedwater line through said economizer heat exchanger wherein both said condensate and said feedwater are in the heat exchange relationship with the flue gas for simultaneously cooling the flue gas while heating both the condensate and the feedwater.

9. A method as defined in claim 7, wherein said condensate return line further circulates through at least one condensate heat exchanger upstream of said economizer heat exchanger, the method comprising cooling the condensate before it comes in the heat exchange relationship with the flue gas within the at least one condensate heat exchanger.

10. A method as defined in claim 9, wherein said at least one condensate heat exchanger comprises a combustion air heat exchanger that is located upstream of said burner, the method comprising simultaneously preheating an air fed into said burner and cooling the condensate within the combustion air heat exchanger.

11. A method as defined in claim 9, wherein said at least one condensate heat exchanger comprises at least one heat recovery heat exchanger, the method comprising simultaneously cooling the condensate and heating a heat recovery fluid used in a heat recovery application, within the at least one heat recovery heat exchanger.

12. A method of circulating water and steam in a steam boiler system of the type comprising:

a steam boiler comprising a burner and a chimney;

a feedwater line;

a steam line leading from said steam boiler to at least one application heat exchanger;

a condensate return line leading out of from said at least one application heat exchanger; and an economizer heat exchanger in said chimney;

said method comprising:

feeding a feedwater to said steam boiler through said feedwater line;

using said burner to generate a steam from said feedwater;

feeding said steam to said at least one application heat exchanger through said steam line;

retrieving a condensate from said at least one application heat exchanger in said condensate return line;

exhausting a flue gas generated by said burner through said economizer heat exchanger in said chimney; and circulating at least one of said condensate return line and said feedwater line through said economizer heat exchanger wherein at least one of said condensate and said feedwater is in a heat exchange relationship with the flue gas for simultaneously cooling the flue gas while heating at least one of the condensate and the feedwater, wherein said feedwater line further circulates through at least one feedwater heat exchanger upstream of said economizer heat exchanger, the method comprising cooling the feedwater before it comes in the heat exchange relationship with the flue gas, within the at least one feedwater heat exchanger, wherein said condensate return line ends in a deaerator downstream of said economizer heat exchanger, and said feedwater line originates at said deaerator upstream of said economizer heat exchanger, the method comprising removing gases from the feedwater in the deaerator and circulating said condensate back at least in part to said steam boiler through said deaerator then through said feedwater line as feedwater; and circulating steam to said deaerator from said steam boiler for preheating said feedwater, wherein said steam boiler comprises a blowdown line that leads to a drain to evacuate a blowdown liquid, said at least one feedwater heat exchanger comprising a heat recovery heat exchanger located on said blowdown line downstream of said steam boiler and upstream of said drain, and located on said make-up water line upstream of said deaerator, the method comprising preheating the make-up water before the make-up water is fed into said deaerator in the heat exchange relationship with the blowdown liquid within said heat recovery heat exchanger.

* * * * *